US009810117B2

(12) United States Patent
Hiraoka et al.

(10) Patent No.: US 9,810,117 B2
(45) Date of Patent: Nov. 7, 2017

(54) MUFFLER CUTTER

(71) Applicant: NICHIAS CORPORATION, Tokyo (JP)

(72) Inventors: Akinao Hiraoka, Tokyo (JP); Isami Abe, Tokyo (JP); Yoshifumi Fujita, Tokyo (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 14/784,332

(22) PCT Filed: Apr. 9, 2014

(86) PCT No.: PCT/JP2014/060314
§ 371 (c)(1),
(2) Date: Oct. 14, 2015

(87) PCT Pub. No.: WO2014/171380
PCT Pub. Date: Oct. 23, 2014

(65) Prior Publication Data

US 2016/0053642 A1 Feb. 25, 2016

(30) Foreign Application Priority Data

Apr. 15, 2013 (JP) ..... 2013-085064

(51) Int. Cl.
*F01N 1/24* (2006.01)
*F01N 1/04* (2006.01)
(Continued)

(52) U.S. Cl.
CPC ..... *F01N 1/24* (2013.01); *F01N 1/006* (2013.01); *F01N 1/04* (2013.01); *F01N 13/082* (2013.01);
(Continued)

(58) Field of Classification Search
CPC ..... F01N 1/24; F01N 1/04; F01N 1/10; F01N 1/125; F01N 13/14; F01N 13/141; F01N 13/148
(Continued)

(56) References Cited

U.S. PATENT DOCUMENTS 3,114,617 A * 12/1963 Rowe ..... F01N 3/0211 55/315.1
3,404,750 A * 10/1968 Powers ..... F01N 1/003 181/228
(Continued)

FOREIGN PATENT DOCUMENTS

DE FR 2328914 A1 * 5/1977 ..... F01N 1/24
DE 102004062632 A1 * 7/2006 ..... F01N 13/14
(Continued)

OTHER PUBLICATIONS

International Search Report dated Jul. 15, 2014, issued in counterpart Application No. PCT/JP2014/060314 (2 pages).
(Continued)

*Primary Examiner* — Edgardo San Martin
(74) *Attorney, Agent, or Firm* — Westerman, Hattori, Daniels & Adrian

(57) ABSTRACT

A muffler cutter is fitted to a tailpipe of a vehicular exhaust system, the muffler cutter includes an exhaust pipe, a plurality of through-holes formed in a side wall of the exhaust pipe, a tubular heat shield plate provided around the exhaust pipe coaxially with the exhaust pipe, and a sound-absorbing heat insulator provided between the exhaust pipe and the tubular heat shield plate. The sound-absorbing heat insulator is partially provided between the exhaust pipe and the tubular heat shield plate so as to have a curved shape. A closed space having a curved shape is formed between the exhaust pipe and the tubular heat shield plate in an area in which the sound-absorbing heat insulator is not provided.
(Continued)

The distance between the exhaust pipe and the tubular heat shield plate in an area in which the closed space is formed is 1 to 50 mm.

20 Claims, 13 Drawing Sheets

(51) Int. Cl.

| | |
|---|---|
| ***F01N 13/14*** | (2010.01) |
| ***F01N 13/20*** | (2010.01) |
| ***F01N 13/08*** | (2010.01) |
| ***F01N 1/00*** | (2006.01) |
| *F01N 1/02* | (2006.01) |
| *F01N 13/00* | (2010.01) |

(52) U.S. Cl.
CPC ..... *F01N 13/14* (2013.01); *F01N 13/20* (2013.01); *F01N 2470/02* (2013.01)

(58) Field of Classification Search
USPC ..... 181/256, 252, 227, 228
See application file for complete search history.

(56) References Cited

U.S. PATENT DOCUMENTS 3,752,260 A * 8/1973 Heath ..... F01N 13/02 181/228
3,963,087 A * 6/1976 Grosseau ..... B60K 13/04 180/309
4,589,515 A * 5/1986 Omura ..... F01N 13/082 181/227
5,726,398 A * 3/1998 Zahn ..... B60K 13/06 181/272
5,912,441 A * 6/1999 Worner ..... F01N 1/06 181/256
5,996,730 A * 12/1999 Pirchl ..... B60R 13/0876 123/195 C
6,267,199 B1 7/2001 Chang
6,302,466 B1 * 10/2001 Zwick ..... B60R 13/08 296/39.3
6,408,980 B1 * 6/2002 Dooley ..... F01N 1/006 180/309
7,004,283 B2 * 2/2006 Worner ..... F01N 1/02 181/239
7,273,129 B2 * 9/2007 Harwood ..... F01N 1/04 181/252
2004/0206573 A1 10/2004 Hsu
2009/0087719 A1 * 4/2009 Kondo ..... H01M 8/0662 429/439
2010/0084219 A1 * 4/2010 Troeger ..... F01N 1/10 181/256
2010/0287919 A1 * 11/2010 Yamagiwa ..... B60K 13/04 60/320
2011/0041945 A1 * 2/2011 Ohmura ..... F01N 3/08 138/140
2013/0056299 A1 * 3/2013 Choi ..... F01N 13/02 181/228
2014/0144539 A1 * 5/2014 Niwa ..... F16L 59/08 138/149

FOREIGN PATENT DOCUMENTS

| | | | |
|---|---|---|---|
| FR | 816537 | A | 8/1937 |
| JP | 2-39533 | U | 3/1990 |
| JP | 2002-256840 | A | 9/2002 |
| JP | 2005-54587 | A | 3/2005 |
| JP | 2008-106630 | A | 5/2008 |
| JP | 2008-190371 | A | 8/2008 |
| JP | 2013100757 | A * | 5/2013 |
| WO | 2013/008810 | A1 | 1/2013 |

OTHER PUBLICATIONS

Extended (Supplementary) European Search Report (EESR) dated Nov. 16, 2016, issued in counterpart European Patent Application No. 14785637.1. (7 pages).

* cited by examiner

MUFFLER CUTTER

TECHNICAL FIELD

The present invention relates to a muffler cutter (i.e., an accessory that is fitted to a muffler).

BACKGROUND ART

A combustion gas (exhaust gas) discharged from an automotive engine is discharged to the outside from the end (tail end) of a tailpipe through an exhaust manifold, a catalytic converter (that is provided directly below the exhaust manifold), a front tube, an underfloor catalytic converter, a center muffler, a main muffler, and the like that are sequentially connected to the engine (see Patent Document 1 (JP-A-2008-190371), for example).

Most of such an automotive exhaust system (exhaust pipe) (e.g., main muffler) is provided at the bottom of the automobile, and is not normally observed from the user. However, since the end (tail end) of the tailpipe that is situated at the end of the exhaust system (exhaust pipe) is exposed under the rear bumper of the automobile, the tailpipe is easily observed from the user, and significantly affects the appearance of the automobile.

Therefore, a muffler cutter is normally provided to the end of the tailpipe so that the appearance and the quality of the automobile are improved.

A high-displacement automobile has a tendency in which the volume of exhaust noise increases, and the load applied to the main muffler and the like increases. Therefore, a muffler cutter that can reduce exhaust noise that could not be absorbed by the main muffler and the like has been desired.

On the other hand, a user who has a preference for an idling sound or like may be dissatisfied if exhaust noise is merely reduced. Therefore, a muffler cutter that can achieve an excellent sound-absorbing capability and an excellent exhaust sound quality-improving capability (that have a trade-off relationship) has also been desired.

RELATED-ART DOCUMENT

Patent Document

Patent Document 1: JP-A-2008-190371

SUMMARY OF THE INVENTION

Technical Problem

An object of the invention is provide a muffler cutter that exhibits an excellent heat-insulating capability and an excellent sound-absorbing capability, and can improve the exhaust sound quality.

Solution to Problem

The inventors of the invention conducted extensive studies in order to solve the above technical problem, and found that the above object can be achieved by a muffler cutter that can selectively reduce only unpleasant high-frequency exhaust noise while selectively enhancing a low-frequency idling sound for which the user may have a preference.

The inventors conducted further extensive studies based on the above finding, and found that the above object can be achieved by a muffler cutter that is fitted to a tailpipe of a vehicular exhaust system, the muffler cutter including an exhaust pipe, a plurality of through-holes being formed in a side wall of the exhaust pipe, a tubular heat shield plate that is provided around the exhaust pipe coaxially with the exhaust pipe, and a sound-absorbing heat insulator that is provided between the exhaust pipe and the tubular heat shield plate, the sound-absorbing beat insulator being partially provided between the exhaust pipe and the tubular heat shield plate so as to have a curved shape, a closed space having a curved shape being formed between the exhaust pipe and the tubular heat shield plate in an area in which the sound-absorbing heat insulator is not provided, and the distance between the exhaust pipe and the tubular heat shield plate in an area in which the closed space is formed being 1 to 50 mm. These findings have led to the completion of the invention.

Specifically, one aspect of the invention provides the following.

(1) A muffler cutter that is fitted to a tailpipe of a vehicular exhaust system, the muffler cutter including:

an exhaust pipe, a plurality of through-holes being formed in a side wall of the exhaust pipe;

a tubular heat shield plate that is provided around the exhaust pipe coaxially with the exhaust pipe, and a sound-absorbing heat insulator that is provided between the exhaust pipe and the tubular heat shield plate, the sound-absorbing heat insulator being partially provided between the exhaust pipe and the tubular heat shield plate so as to have a curved shape, a closed space having a curved shape being formed between the exhaust pipe and the tubular heat shield plate in an area in which the sound-absorbing heat insulator is not provided, and the distance between the exhaust pipe and the tubular heat shield plate in an area in which the closed space is formed being 1 to 50 mm.

(2) The muffler cutter according to (1), wherein the plurality of through-holes are formed in at least an area of the side wall of the exhaust pipe that is situated opposite to the sound-absorbing heat insulator.

(3) The muffler cutter according to (1), wherein the sound-absorbing heat insulator is provided between the exhaust pipe and the tubular heat shield plate so as to have a curved shape within an area that is situated on the side of a vehicle main body when the muffler cutter is fitted.

(4) The muffler cutter according to (2), wherein the sound-absorbing heat insulator is provided between the exhaust pipe and the tubular heat shield plate so as to hove a curved shape within an area that is situated on the side of a vehicle main body when the muffler cutter is fitted.

(5) The muffler cutter according to (3), wherein the closed space is a hollow space, and is formed between the exhaust pipe and the tubular heat shield plate so as to have a curved shape within an area that is situated opposite to the vehicle main body when the muffler cutter is fitted.

(6) The muffler cutter according to (4), wherein the closed space is a hollow space, and is formed between the exhaust pipe and the tubular heat shield plate so as to have a curved shape within an area that is situated opposite to the vehicle main body when the muffler cutter is fitted.

(7) The muffler cutter according to any one of (1) to (6), wherein the sound-absorbing heat insulator has a thermal conductivity measured at 400° C. of 0.01 to 0.1 W/(m·K).

Advantageous Effects of the Invention

The muffler cutter according to one aspect of the invention can selectively enhance the volume of a low-frequency idling sound for which the user may have a preference while selectively reducing only unpleasant high-frequency noise since the closed space having a curved shape is partially formed between the exhaust pipe and the tubular heat shield plate, and the distance between the exhaust pipe and the tubular heat shield plate in an area in which the closed space is formed is set to a given distance. Moreover, since the sound-absorbing heat insulator is provided between the exhaust pipe and the tubular heat shield plate in an area in which the closed space is not formed, the muffler cutter according to one aspect of the invention can further reduce the high-frequency noise. The muffler cutter according to one aspect of the invention thus exhibits an excellent heat-insulating capability and an excellent sound-absorbing capability, and can improve the exhaust sound quality.

DESCRIPTION OF EMBODIMENTS

A muffler cutter according to one embodiment of the invention is fitted to a tailpipe of a vehicular exhaust system, the muffler cutter including: an exhaust pipe, a plurality of through-holes being formed in a side wall of the exhaust pipe; a tubular heat shield plate that is provided around the exhaust pipe coaxially with the exhaust pipe; and a sound-absorbing heat insulator that is provided between the exhaust pipe and the tubular heat shield plate, the sound-absorbing heat insulator being partially provided between the exhaust pipe and the tubular heat shield plate so as to have a curved shape, a closed space having a curved shape being formed between the exhaust pipe and the tubular heat shield plate in an area in which the sound-absorbing heat insulator is not provided, and the distance between the exhaust pipe and the tubular heat shield plate in an area in which the closed space is formed being 1 to 50 mm.

The muffler cutter according to one embodiment of the invention is described below with appropriate reference to the drawings.

Figure 1:
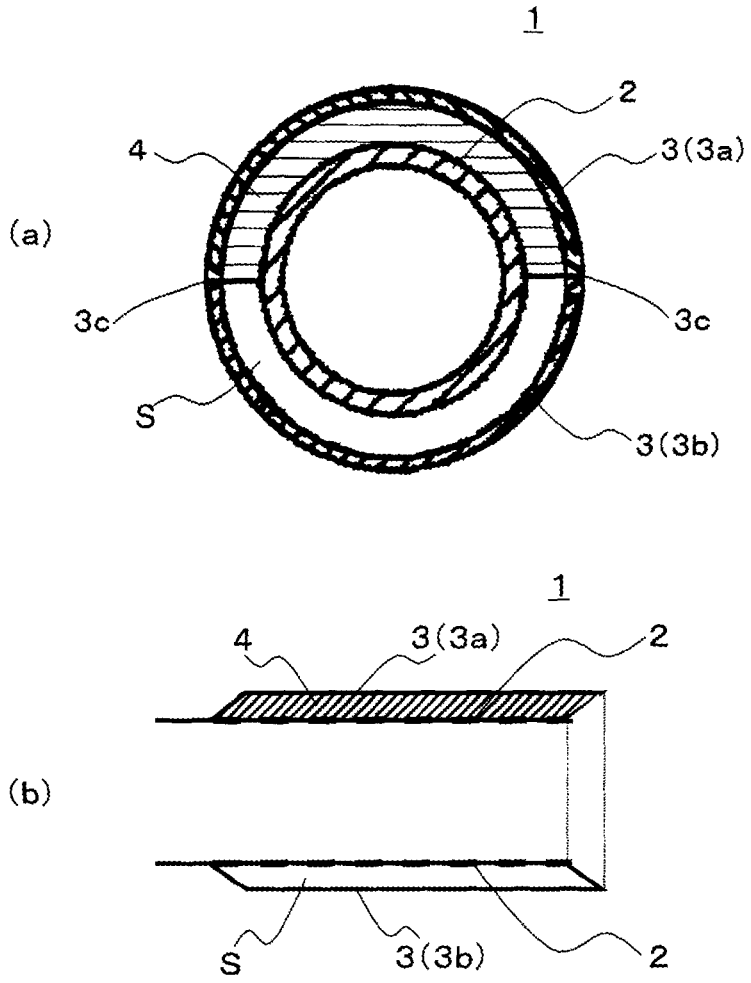
FIG. 1 is a cross-sectional view illustrating an example of a muffler cutter according to one embodiment of the invention, wherein (a) is a vertical cross-sectional view illustrating the muffler cutter taken along the direction orthogonal to the longitudinal direction, and (b) is a vertical cross-sectional view illustrating the muffler cutter taken along the longitudinal direction.

FIG. 1 is a cross-sectional view illustrating an example of a muffler cutter 1 according to one embodiment of the invention, wherein (a) is a vertical cross-sectional view illustrating the muffler cutter 1 taken along the direction orthogonal to the longitudinal direction, and (b) is a vertical cross-sectional view illustrating the muffler cutter 1 taken along the longitudinal direction.

As illustrated in FIG. 1, the muffler cutter 1 according to one embodiment of the invention includes an exhaust pipe 2.

The term "exhaust pipe" used herein refers to a tubular article through which an exhaust gas (combustion gas) circulates. It is preferable to appropriately select an exhaust pipe that is formed of a material that can endure the temperature and the like of the exhaust gas that circulates therethrough, and exhibits the desired temperature characteristics and the desired sound-absorbing capability.

It is preferable to use an exhaust pipe that exhibits heat resistance. Specific examples of the exhaust pipe include a metal pipe, a resin pipe that is formed of a heat-resistant resin, and the like. It is preferable to use a metal pipe as the exhaust pipe.

A stainless steel pipe (SUS pipe) is mainly used as the metal pipe from the viewpoint of heat resistance and corrosion resistance. Note that an aluminum pipe may also be used.

The average thickness of the exhaust pipe is preferably 0.5 to 2.0 mm, more preferably 0.6 to 1.8 mm, and still more preferably 0.6 to 1.5 mm.

Note that the term "average thickness" used herein in connection with the exhaust pipe refers to the arithmetic mean value of the thicknesses of the exhaust pipe measured at three points using calipers.

The outer diameter of the exhaust pipe is preferably 20 to 250 mm, more preferably 20 to 200 mm, still more preferably 25 to 150 mm, and yet more preferably 30 to 100 mm.

The term "outer diameter" used herein in connection with the exhaust pipe refers to the dimension (diameter) of the vertical cross section of the exhaust pipe measured using calipers. When the vertical cross section of the exhaust pipe has a shape other than a circular shape, the term "outer diameter" used herein in connection with the exhaust pipe refers to the maximum length of the vertical cross section of the exhaust pipe measured using calipers.

When the average thickness and the outer diameter of the exhaust pipe are within the above ranges, the temperature inside the exhaust pipe and the temperature outside the exhaust pipe can be easily controlled within a preferable range.

The cross-sectional shape of the exhaust pipe is not particularly limited. The exhaust pipe may have a circular cross-sectional shape (see (a) (cross-sectional view) in FIG. 1), an elliptical cross-sectional shape, or the like.

A plurality of through-holes are formed in the side wall of the exhaust pipe included in the muffler cutter according to one embodiment of the invention.

The through-holes may have a circular shape, a quadrangular shape, a slit-like shape, or the like.

The exhaust pipe provided with the through-holes may be produced by forming holes in a metal pipe, or a commercially-available product (e.g., perforated metal) may be used as the exhaust pipe provided with the through-holes.

When a plurality of holes are formed in the side wall of the exhaust pipe (in the longitudinal direction), it is considered that interference occurs while exhaust noise that has entered the closed space formed between the exhaust pipe and the tubular heat shield plate (described later) makes a round trip, and the sound pressure of high-frequency noise decreases (i.e., the capability to absorb high-frequency noise is improved) while the sound pressure of low-frequency noise (i.e., the volume of low-frequency noise) increases.

The through-holes are preferably formed in the exhaust pipe included in the muffler cutter according to one embodiment of the invention in an area ratio of 1 to 95%, more preferably 20 to 70%, and still more preferably 25 to 50%, based on the total outer surface area of the side wall of the exhaust pipe where the through-holes are formed.

If the through-holes are formed in the exhaust pipe in an area ratio of more than 95% based on the total outer surface area of the side wall of the exhaust pipe where the through-holes are formed, the exhaust pipe may not exhibit sufficient strength. If the through-holes are formed in the exhaust pipe in an area ratio of less than 1% based on the total outer surface area of the side wall of the exhaust pipe where the through-holes are formed, it may be difficult to achieve the effect of increasing the volume of low-frequency noise, and the effect of improving the capability to absorb high-frequency noise.

Note that the expression "total outer surface area of the side wall of the exhaust pipe where the through-holes are formed" used herein refers to the area of a region defined by connecting the outermost through-holes among the through-holes formed in the side wall of the exhaust pipe.

The through-holes are preferably formed in the downstream-side (i.e., exhaust gas discharge side) area of the side wall of the exhaust pipe included in the muffler cutter according to one embodiment of the invention. The through-holes are more preferably formed in the area of the side wall of the exhaust pipe situated on the downstream side (i.e., exhaust gas discharge side) with respect to the center of the exhaust pipe in the longitudinal direction.

When the through-holes are formed in the upstream-side (i.e., exhaust gas inflow side) area of the side wall of the exhaust pipe, interference more easily occurs since exhaust noise that has entered the closed space formed between the exhaust pipe and the tubular heat shield plate (described later) makes a long-distance round trip within the closed space along the longitudinal direction, and the sound pressure of low-frequency noise and the sound pressure of high-frequency noise easily decrease. On the other hand, when the through-holes are formed in the downstream-side (i.e., exhaust gas discharge side) area of the side wall of the exhaust pipe, moderate interference occurs since exhaust noise that has entered the closed space formed between the exhaust pipe and the tubular heat shield plate (described later) makes a short-distance round trip within the closed space in the direction perpendicular to the longitudinal direction, and the sound pressure of high-frequency noise easily decreases (i.e., the capability to absorb high-frequency noise is improved) while the sound pressure of low-frequency noise (i.e., the volume of low-frequency noise) easily increases.

The through-holes are preferably formed in at least an area of the side wall (side) of the exhaust pipe included in the muffler cutter according to one embodiment of the invention that is situated opposite to the sound-absorbing heat insulator (described later).

The through-holes are preferably formed in the side wall (side) of the exhaust pipe included in the muffler cutter according to one embodiment of the invention so that 50 to 100% (more preferably 80 to 100%, still more preferably 90 to 1000%, and yet more preferably 100%) of the through-holes are situated opposite to the sound-absorbing heat insulator (described later).

For example, when the outer surface of the exhaust pipe included in the muffler cutter according to one embodiment of the invention is divided so as to form two semi-cylindrical sections, the through-holes are more preferably formed in the side wall (side) of the semi-cylindrical section that is situated on the side of the vehicle main body when the muffler cutter is fitted.

When the through-holes are formed in the side wall (side) of the exhaust pipe in an area situated opposite to the sound-absorbing heat insulator (i.e., when the muffler cutter is configured so that exhaust gas enters the closed space from the through-holes through the sound-absorbing heat insulator), the sound-absorbing heat insulator effectively achieves the effect of improving the capability to absorb high-frequency noise. The sound-absorbing heat insulator more effectively achieves the effect of improving the capability to absorb high-frequency noise as the ratio of the through-holes formed in an area situated opposite to the sound-absorbing beat insulator increases.

As illustrated in FIG. 1, the muffler cutter 1 according to one embodiment of the invention includes a tubular heat shield plate 3 that is provided around the exhaust pipe 2 coaxially with the exhaust pipe 2.

Since the muffler cutter according to one embodiment of the invention has a coaxial double circular pipe structure that is formed by the exhaust pipe and the tubular heat shield plate that is provided around the exhaust pipe coaxially with the exhaust pipe, noise that diffuses from the side wall of the inner pipe (exhaust pipe) can be reflected (collected) by the outer pipe (tubular heat shield plate), and the sound pressure can be increased over a wide range from a low-frequency region to a high-frequency region. Since a plurality of holes are formed in the side wall of the exhaust pipe (in the longitudinal direction) (see above), it is considered that interference of sound waves occurs, and the sound pressure of high-frequency noise decreases (i.e., the capability to absorb high-frequency noise is improved) while the sound pressure of low-frequency noise (i.e., the volume of low-frequency noise) increases.

The term "heat shield plate" used herein refers to a member that can suppress a situation in which heat emitted from exhaust gas that circulates through the exhaust pipe is applied to the vehicle main body. It is preferable to appropriately select a heat shield plate that is formed of a material that exhibits heat resistance sufficient to endure heat that may be applied to the vehicle main body, and does not show deterioration and the like.

It is preferable to use a heat shield plate that exhibits heat resistance and has a good appearance as the tubular heat shield plate. A heat shield plate formed of a metal may be used as the tubular heat shield plate.

Stainless steel (SUS) is mainly used as the metal for forming the tubular heat shield plate from the viewpoint of heat resistance, corrosion resistance, appearance, and the like. The tubular heat shield plate may be formed of aluminum. Note that it is preferable to use stainless steel due to low emissivity and good appearance.

The tubular heat shield plate included in the muffler cutter according to one embodiment of the invention preferably has an emissivity at a wavelength of 2 to 15 μm of 0.1 to 50% (more preferably 0.1 to 40%, and still more preferably 0.1 to 30%).

When the emissivity of the tubular heat shield plate included in the muffler cutter according to one embodiment of the invention is within the above range, it is possible to more effectively suppress release of heat from exhaust gas to the vehicle main body, and easily suppress thermal deterioration in the vehicle main body.

The term "emissivity (%)" used herein refers to a value calculated using the following expression.

$$\text{Emissivity (\%)} = 100 - \text{reflectivity (\%)} - \text{transmissivity (\%)}$$

Note that the reflectivity (%) and the transmissivity (%) refer to values calculated using the following expressions from the incident light intensity, the reflected light intensity, and the transmitted light intensity measured using a high-temperature reflectivity-transmissivity measurement device when electromagnetic waves having a wavelength of 2 to 15 μm are applied to a measurement sample (heat shield plate) at 25° C.

$$\text{Reflectivity (\%)} = (\text{reflected light intensity}/\text{incident light intensity}) \times 100$$

$$\text{Transmissivity (\%)} = (\text{transmitted light intensity}/\text{incident light intensity}) \times 100$$

Figure 4:
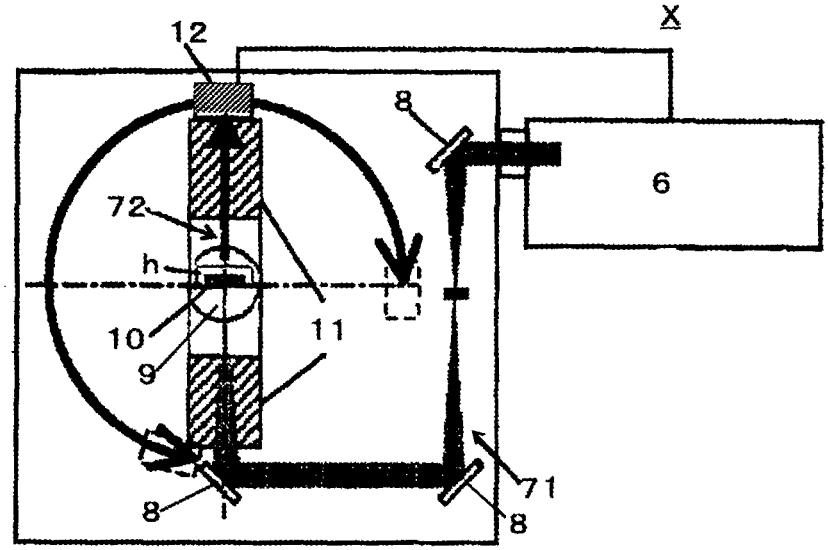
FIG. 4 is a schematic view illustrating a high-temperature reflectivity-transmissivity measurement device that is used to measure emissivity.

FIG. 4 is a schematic view illustrating an example of the high-temperature reflectivity-transmissivity measurement device.

A high-temperature reflectivity-transmissivity measurement device X illustrated in FIG. 4 is configured so that incident light 71 (wavelength: 2 to 15 μm) applied from a Fourier transform infrared spectrophotometer ("FT-IR6100" manufactured by JASCO Corporation) 6 is reflected by mirrors 8, introduced into a sample chamber, and applied to a sample 10 mounted at the center of a rotary stage 9. The sample 10 is heated by halogen heaters 11 ("UL-SH-V500" manufactured by Ushio, Inc.) in a state in which the sample 10 is mounted on a holder h that is provided at the center of the rotary stage 9. The intensity of reflected light from the sample 10 or the intensity of transmitted light 72 is detected by a detector 12 that is provided to an arm section of the rotary stage 9 that rotates around the mounting section for the sample 10, and rotates around the sample 10.

Figure 5:
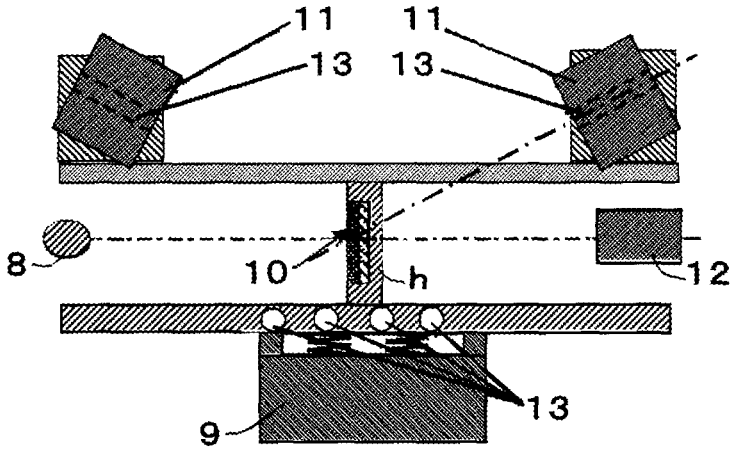
FIG. 5 is a cross-sectional view illustrating a heating section of a high-temperature reflectivity-transmissivity measurement device that is used to measure emissivity.

FIG. 5 is a cross-sectional view illustrating an example of the structure of the heating section of the high-temperature reflectivity-transmissivity measurement device X.

As illustrated in FIG. 5, the halogen heaters 11 are respectively provided on the front side and the back side of the sample 10. The halogen heaters 11 are provided above the sample 10 to form an angle relative to the sample 10 so that the halogen heaters 11 do not block the optical path when the detector 12 detects the reflected light or the transmitted light from the sample 10. When measuring the reflected light or the transmitted light, the halogen heaters 11 are rotated together with the sample 10 so that the surface temperature of the sample 10 can be always maintained at a constant temperature. Cooling water 13 is introduced (circulated) from the outside into the bottom of the rotary stage 9 (on which the sample 10 is mounted) and the halogen heaters 11 to effect cooling.

The average thickness of the tubular heat shield plate is preferably 0.5 to 2.0 mm, more preferably 0.6 to 1.8 mm, and still more preferably 0.6 to 1.5 mm.

Note that the term "average thickness" used herein in connection with the tubular heat shield plate refers to the arithmetic mean value of the thicknesses of the tubular heat shield plate measured at three points using calipers.

The outer diameter of the tubular heat shield plate is preferably 70 to 300 mm, more preferably 120 to 300 mm, still more preferably 125 to 250 mm, and yet more preferably 130 to 200 mm.

The term "outer diameter" used herein in connection with the tubular heat shield plate refers to the dimension (diameter) of the vertical cross section of the tubular heat shield plate measured using calipers. When the vertical cross section of the tubular heat shield plate has a shape other than a circular shape, the term "outer diameter" used herein in connection with the tubular heat shield plate refers to the maximum length of the vertical cross section of the tubular heat shield plate measured using calipers.

When the average thickness and the outer diameter of the tubular heat shield plate are within the above ranges, the temperature inside the heat shield plate and the temperature outside the heat shield plate can be easily controlled within a preferable range.

The cross-sectional shape of the heat shield plate is not particularly limited. The heat shield plate may have an approximately circular cross-sectional shape (see (a) in FIG. 1), an elliptical cross-sectional shape, or the like.

The tubular heat shield plate 3 included in the muffler cutter according to one embodiment of the invention preferably includes an upper heat shield plate 3*a* and a lower heat shield plate 3*b* that are obtained by halving a tubular article (see FIG. 1).

When the heat shield plate 3 includes the upper heat shield plate 3*a* and the lower heat shield plate 3*b* that are obtained by halving a tubular article, it is possible to easily produce the muffler cutter according to one embodiment of the invention as described later.

As illustrated in FIG. 1, the muffler cutter 1 according to one embodiment of the invention has a structure in which only part of the space formed between the exhaust pipe 2 and the tubular heat shield plate 3 (that is provided to be coaxial with the exhaust pipe 2) is provided with a sound-absorbing heat insulator 4 having a curved shape (i.e., an approximately C-like shape), and a closed space S having a curved shape (i.e., an approximately C-like shape) is formed between the exhaust pipe 2 and the tubular heat shield plate 3 in an area in which the sound-absorbing heat insulator 4 is not provided.

The sound-absorbing heat insulator included in the muffler cutter according to one embodiment of the invention is a heat-insulating material that can reduce the sound pressure level of unpleasant vehicular exhaust noise having a ⅓-octave band frequency of 800 to 20,000 Hz.

Examples of the sound-absorbing heat insulator included in the muffler cutter according to one embodiment of the invention include a fibrous heat-insulating material such as a glass wool mat (glass mat), a silica fiber mat, a basalt fiber mat, an alumina-silica fiber mat, a mullite fiber mat, and an alumina fiber mat.

The thermal conductivity of the sound-absorbing heat insulator included in the muffler cutter according to one embodiment of the invention measured at 400° C. is preferably 0.01 to 0.1 W/(m·K), more preferably 0.001 to 0.08 W/(m·K), and still more preferably 0.001 to 0.06 W/(m·K).

The thermal conductivity of the sound-absorbing heat insulator included in the muffler cutter according to one embodiment of the invention measured at room temperature (25° C.) is preferably 0.01 to 0.1 W/(m·K), more preferably 0.001 to 0.08 W/(m·K), and still more preferably 0.001 to 0.06 W/(m·K).

The term "thermal conductivity" used herein in connection with the sound-absorbing heat insulator refers to a value measured using a heat flow meter method.

Figure 2:
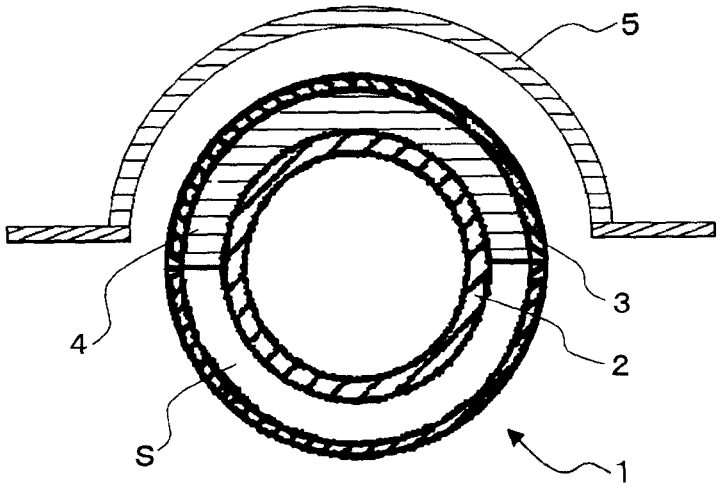
FIG. 2 is a view illustrating a state when a muffler cutter according to one embodiment of the invention is used.

The muffler cutter 1 according to one embodiment of the invention preferably has a structure in which the sound-absorbing heat insulator 4 is provided between the exhaust pipe 2 and the tubular heat shield plate 3 situated on the side of a vehicle main body 5 (when the muffler cutter 1 is fitted) so as to have a curved shape (see FIG. 2).

When the muffler cutter 1 according to one embodiment of the invention has a structure in which the sound-absorbing heat insulator 4 is provided on the side of the vehicle main body 5, it is possible to more effectively suppress thermal deterioration in the vehicle main body 5 due to the heat of exhaust gas.

The thickness of the sound-absorbing heat insulator included in the muffler cutter according to one embodiment of the invention is preferably 1 to 50 mm, more preferably 1 to 30 mm, still more preferably 4 to 20 mm, and yet more preferably 4 to 12 mm.

Note that the term "thickness" used herein in connection with the sound-absorbing heat insulator refers to the arithmetic mean value of the thicknesses of the sound-absorbing heat insulator measured at five points using a Peacock dial thickness gauge (manufactured by Ozaki Mfg. Co., Ltd.).

When the thickness of the sound-absorbing heat insulator included in the muffler cutter according to one embodiment of the invention is within the above range, it is possible to easily improve the capability to absorb high-frequency noise when the sound-absorbing heat insulator is provided between the exhaust pipe and the heat shield plate, and more effectively improve the heat-insulating capability due to the heat-insulating material and the tubular heat shield plate.

Note that the upper limit of the thickness of the sound-absorbing heat insulator included in the muffler cutter according to one embodiment of the invention is determined by the distance between the exhaust pipe and the tubular heat shield plate between which the sound-absorbing heat insulator is provided.

The bulk density of the sound-absorbing heat insulator included in the muffler cutter according to one embodiment of the invention is preferably 50 to 400 kg/m$^3$, more preferably 80 to 350 kg/m$^3$, and still more preferably 100 to 300 kg/m$^3$.

When the thickness and the bulk density of the sound-absorbing heat insulator included in the muffler cutter according to one embodiment of the invention are within the above ranges, it is possible to easily improve the capability to absorb high-frequency noise, easily suppress thermal deterioration in the member of the vehicle main body that is situated opposite to the muffler cutter, and easily control the temperature inside the exhaust pipe within a given range.

The sound-absorbing heat insulator included in the muffler cutter according to one embodiment of the invention is provided between the exhaust pipe and the tubular heat shield plate so as to have a curved shape. The sound-absorbing heat insulator is preferably provided to cover 20 to 80%/(more preferably 30 to 70%, and still more preferably 40 to 60%) of the total outer surface area of the exhaust pipe.

The placement position and the placement area (with respect to the total outer surface area of the exhaust pipe) of the sound-absorbing heat insulator included in the muffler cutter according to one embodiment of the invention may be appropriately determined taking account of the shape of the member of the vehicle main body that is situated opposite to the sound-absorbing heat insulator, the sound-absorbing capability or the heat-insulating capability desired for the sound-absorbing heat insulator, and the like.

For example, when the outer surface of the exhaust pipe included in the muffler cutter according to one embodiment of the invention is divided so as to form two semi-cylindrical sections, the sound-absorbing heat insulator is preferably provided to cover the entire outer surface of the semi-cylindrical section that is situated on the side of the vehicle main body when the muffler cutter is fitted.

Specifically, when the outer surface of the exhaust pipe 2 is divided so as to form two semi-cylindrical sections, the sound-absorbing heat insulator 4 is preferably provided to cover almost the entire outer surface of the semi-cylindrical section that is situated on the side of the vehicle main body 5 (see FIG. 2 (cross-sectional view)).

When the sound-absorbing heat insulator 4 is provided as described above in combination with the heat shield plate 3, it is possible to effectively suppress radiation of heat toward the vehicle main body 5 (i.e., advantageously suppress thermal deterioration in the member of the vehicle main body 5) while reducing exhaust noise (that could not be absorbed by the main muffler and the like) when the muffler cutter is fitted to the tailpipe of the vehicular exhaust system.

As illustrated in FIG. 1, the muffler cutter 1 according to one embodiment of the invention has a structure in which the closed space S having a curved shape is partially formed between the exhaust pipe 2 and the tubular heat shield plate 3.

The muffler cutter 1 according to one embodiment of the invention has a structure in which the closed space S is formed between the exhaust pipe 2 and the tubular heat shield plate 3 so as to have a curved shape. The closed space S is preferably formed so that the closed space S covers 20 to 80% of the total outer surface area of the exhaust pipe 2 (i.e., the sound-absorbing heat insulator 4 is provided to cover 20 to 80% of the total outer surface area of the exhaust pipe). The closed space S is more preferably formed so that the closed space S covers 30 to 70% of the total outer surface area of the exhaust pipe 2 (i.e., the sound-absorbing heat insulator 4 is provided to cover 30 to 70% of the total outer surface area of the exhaust pipe). The closed space S is still more preferably formed so that the closed space S covers 40 to 60% of the total outer surface area of the exhaust pipe 2 (i.e., the sound-absorbing heat insulator 4 is provided to cover 40 to 60% of the total outer surface area of the exhaust pipe).

The term "closed space" used herein in connection with the muffler cutter according to one embodiment of the invention refers to a space defined by the exhaust pipe, the tubular heat shield plate, and the sound-absorbing heat insulator.

As illustrated in FIG. 1 (see (a) and (b)), the closed space S is normally defined by the exhaust pipe 2, the tubular heat shield plate 3, and the sound-absorbing heat insulator 4 to form a hollow space. As illustrated in FIG. 1 (see (b)), each end of the closed space S in the longitudinal direction is normally closed by a wall.

A wall (partition wall) is normally not provided at the boundary between the sound-absorbing heat insulator 4 and the closed space S so that exhaust gas can move through the sound-absorbing heat insulator 4 and the closed space S (i.e., the sound-absorbing heat insulator 4 communicates with the closed space S). When a wall is not provided between the sound-absorbing heat insulator 4 and the closed space S, exhaust gas can enter the closed space S from the through-holes formed in the exhaust pipe 2 through the sound-absorbing heat insulator 4, for example. Therefore, the sound-absorbing heat insulator 4 more effectively exhibits the effect of improving the capability to absorb high-frequency noise.

Since the muffler cutter according to one embodiment of the invention has a (approximately) coaxial double circular pipe structure that is formed by the exhaust pipe and the tubular heat shield plate that is provided around the exhaust pipe coaxially with the exhaust pipe, noise that diffuses from the side wall of the inner pipe (exhaust pipe) can be reflected (collected) by the outer pipe (tubular heat shield plate), and the sound pressure can be increased over a wide range from a low-frequency region to a high-frequency region. Since a plurality of holes are formed in the side wall of the exhaust pipe (in the longitudinal direction) (see above), it is considered that interference of sound waves occurs, and the sound pressure of high-frequency noise decreases (i.e., the capability to absorb high-frequency noise is improved) while the sound pressure of low-frequency noise (i.e., the volume of low-frequency noise) increases.

The atmosphere inside the closed space is preferably an air atmosphere, an inert atmosphere (e.g., nitrogen), or a vacuum atmosphere. The atmosphere inside the closed space is more preferably an air atmosphere.

The closed space S may be appropriately provided with a back-up material such as glass wool, steel wool, or aluminum wool as long as the advantageous effects of the invention are not impaired.

The muffler cutter according to one embodiment of the invention preferably has a structure in which the closed space is a hollow space, and is formed between the exhaust pipe and the tubular heat shield plate so as to have a curved shape within an area that is situated opposite to the vehicle main body when the muffler cutter is fitted.

For example, when the outer surface of the exhaust pipe is divided so as to form two semi-cylindrical sections, the closed space is preferably formed corresponding to the outer surface of the semi-cylindrical section that is situated opposite to the vehicle main body when the muffler cutter is fitted.

Specifically, when the outer surface of the exhaust pipe 2 is divided so as to form two semi-cylindrical sections, the closed space S is preferably formed corresponding to approximately the entire outer surface of the semi-cylindrical section that is situated opposite to the vehicle main body 5 (see FIG. 2 (cross-sectional view)).

When the closed space is formed as described above, it is possible to easily increase the volume of low-frequency noise, and easily promote radiation of heat from exhaust gas toward the side opposite to the vehicle main body when the muffler cutter is fitted to the tailpipe of a vehicular exhaust system.

The distance between the exhaust pipe and the tubular heat shield plate included in the muffler cutter according to one embodiment of the invention in an area in which the closed space is formed is 1 to 50 mm, preferably 1 to 30 mm, more preferably 4 to 20 mm, and still more preferably 4 to 12 mm.

When the distance between the exhaust pipe and the tubular heat shield plate (included in the muffler cutter according to one embodiment of the invention) in an area in which the closed space is formed is within the above range, it is possible to effectively increase the volume of low-frequency noise.

Figure 3:
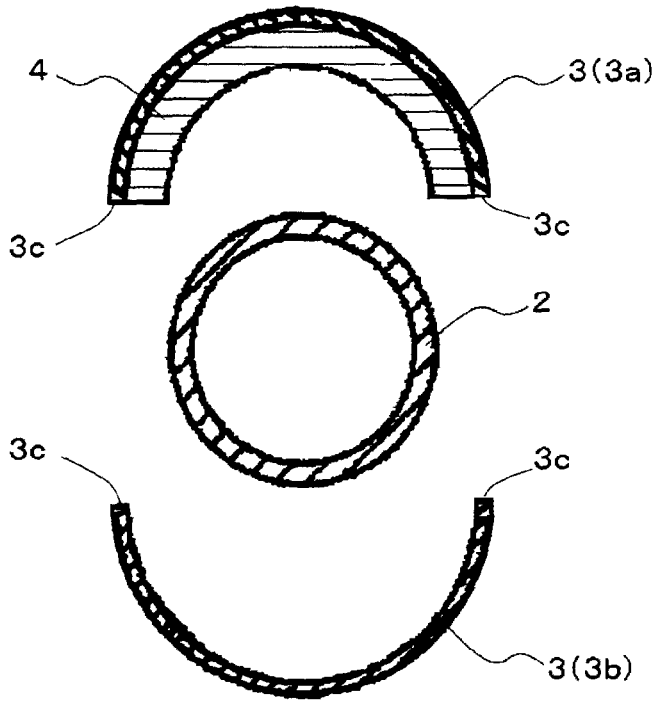
FIG. 3 is a view illustrating a production example of a muffler cutter according to one embodiment of the invention.

The muffler cutter according to one embodiment of the invention may be produced by providing the semi-circular (halved) sound-absorbing heat insulator 4 having a curved shape, bonding the sound-absorbing heat insulator 4 to the inner surface of the upper heat shield plate 3*a* (obtained by halving a tubular article) using an adhesive, placing the upper heat shield plate 3*a* (to which the sound-absorbing heat insulator 4 has been bonded) and the lower heat shield plate 3*b* (obtained by halving a tubular article) to surround the exhaust pipe 2, and joining the ends 3*c* of the upper heat shield plate 3*a* and the lower heat shield plate 3*b* by butt welding (see FIG. 3). Alternatively, a flange or the like may be provided to the ends 3*c*, and the ends 3*c* may be connected using a connection member such as a bolt (not illustrated in FIG. 3).

The muffler cutter according to one embodiment of the invention may also be produced by placing the tubular heat shield plate around the exhaust pipe, and injecting the material for forming the sound-absorbing heat insulator into the desired position between the exhaust pipe and the tubular heat shield plate to form the sound-absorbing heat insulator.

The muffler cutter according to one embodiment of the invention is preferably fitted to the end of a tailpipe so that the distance from the member (member to be heated) of the vehicle main body is 0 to 50 mm, more preferably 1 to 50 mm, still more preferably 1 to 40 mm, and yet more preferably 1 to 35 mm.

Specific examples of the member of the vehicle main body include a bumper and the like.

Since the muffler cutter according to one embodiment of the invention can suppress radiation of heat toward the vehicle main body (i.e., exhibits an excellent heat-insulating capability), the muffler cutter can be provided at a short distance from the member of the vehicle main body.

Specific examples of the vehicle to which the muffler cutter according to one embodiment of the invention is fitted include an automobile, a motorcycle, and the like.

The muffler cutter according to one embodiment of the invention can selectively reduce only unpleasant high-frequency noise since the sound-absorbing heat insulator is partially provided between the exhaust pipe and the tubular heat shield plate. Since the closed space is formed between the exhaust pipe and the tubular heat shield plate so as to have a curved shape in an area in which the sound-absorbing heat insulator is not provided, and the distance between the exhaust pipe and the tubular heat shield plate in an area in which the closed space is formed is set to a given distance, the muffler cutter according to one embodiment of the invention can selectively enhance the volume of a low-frequency idling sound. The muffler cutter according to one embodiment of the invention thus exhibits an excellent sound-absorbing capability, and can improve the exhaust sound quality.

Note that the term "high-frequency noise" used herein refers to noise (sound) having a ⅓-octave band frequency of 800 to 20,000 Hz, and the term "low-frequency noise" used herein refers to noise (sound) having a ⅓-octave band frequency of 20 to 200 Hz.

According to one embodiment of the invention, since the tubular heat shield plate is provided around the exhaust pipe coaxially with the exhaust pipe, radiation of heat toward the outside can be advantageously suppressed even when a high-temperature fluid circulates through the exhaust pipe. Since the sound-absorbing heat insulator is partially provided between the exhaust pipe and the tubular heat shield plate, radiation of heat (from the side where the sound-absorbing heat insulator is provided) toward the outside can be further suppressed, and heat can be selectively dissipated from the closed space due to a difference in radiation of heat with respect to the closed space. It is thus possible to provide a muffler cutter exhibiting an excellent heat-insulating capability that can suppress radiation of heat toward the vehicle main body (i.e., the side where the sound-absorbing heat insulator is provided), and can efficiently dissipate heat toward the side (closed space) opposite to the vehicle main body (i.e., can decrease the internal temperature).

The muffler cutter according to one embodiment of the invention is used as described below.

The muffler cutter according to one embodiment of the invention may suitably be used as a tailpipe member.

The total length (excluding the length of the muffler cutter) of the tailpipe provided with the muffler cutter according to one embodiment of the invention is preferably 50 to 500 mm, more preferably 50 to 300 mm, and still more preferably 50 to 200 mm.

Figure 6:
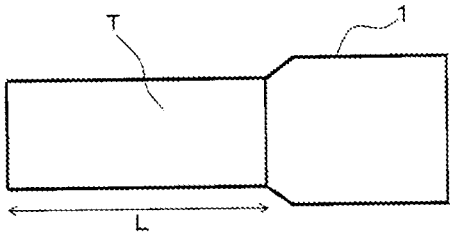
FIG. 6 is a view illustrating the total length of a tailpipe.

Note that the total length (excluding the length of the muffler cutter) of the tailpipe provided with the muffler cutter according to one embodiment of the invention refers to the length L of a tailpipe T (see FIG. 6) of a vehicular exhaust system in which the muffler cutter 1 is fitted to one end of the tailpipe main body.

When the total length (excluding the length of the muffler cutter) of the tailpipe provided with the muffler cutter according to one embodiment of the invention is within the above range, the sound-absorbing effect and the exhaust sound quality-improving effect due to the muffler cutter according to one embodiment of the invention can be appropriately achieved.

The muffler cutter may be fitted to the tailpipe by welding or the like. The muffler cutter may be fitted to the tailpipe when the vehicle is assembled in a factory, or may be fitted to the tailpipe at an arbitrary timing after the vehicle has been shipped from the factory.

Specific examples of the vehicle that is provided with the tailpipe to which the muffler cutter according to one embodiment of the invention is fitted include an automobile, a motorcycle, and the like.

The embodiments of the invention thus provide a muffler cutter that exhibits an excellent heat-insulating capability and an excellent sound-absorbing capability, and can improve the exhaust sound quality by selectively reducing only unpleasant high-frequency noise, and selectively enhancing the volume of a low-frequency idling sound.

EXAMPLES

The invention is further described below by way of examples and the like. Note that the invention is not limited to the following examples.

Example 1

An SUS pipe (inner diameter: 52 mm, outer diameter: 54 mm, thermal conductivity (400° C.): 27 W/(m·K)) in which a plurality of holes (openings) were formed in the entire side wall in the longitudinal direction (in the same manner as a perforated metal) was provided as the exhaust pipe 2, and an SUS pipe (inner diameter: 66 mm, outer diameter: 68 mm, thermal conductivity (400° C.): 27 W/(m·K), emissivity (wavelength: 2 to 15 μm): 0.3) consisting of an upper heat shield plate 3*a* and a lower heat shield plate 3*b* (obtained by halving a tubular article) was provided as the tubular heat shield plate 3 (see FIG. 3).

A gap having a width of 6 mm was formed between the exhaust pipe 2 and the tubular heat shield plate 3 when the exhaust pipe 2 and the tubular heat shield plate 3 were positioned coaxially. A semi-circular (halved) glass wool article (thickness: 6 mm, density: 100 kg/m$^3$, thermal conductivity (400° C.): 0.09 W/(m·K)) was provided as the sound-absorbing heat insulator 4 (see FIG. 3).

The sound-absorbing heat insulator 4 was bonded to the inner surface of the upper heat shield plate 3*a* using an adhesive. The upper heat shield plate 3*a* and the lower heat shield plate 3*b* were placed to surround the exhaust pipe 2, and the ends 3*c* of the upper heat shield plate 3*a* and the lower heat shield plate 3*b* were joined by butt welding (see FIG. 3) to produce a muffler cutter 1 (see FIG. 1) having a structure in which the sound-absorbing heat insulator 4 was provided between the exhaust pipe 2 and the tubular heat shield plate 3 (3*a*) so as to have a curved shape, a closed space S (cavity) having a curved shape was partially formed between the exhaust pipe 2 and the tubular heat shield plate 3 (3*b*), and the distance between the exhaust pipe 2 and the tubular heat shield plate 3 (3*b*) (between which the closed space S was formed) was 6 mm.

An SUS pipe (inner diameter 66 mm, outer diameter: 68 mm, thermal conductivity (400° C.): 27 W/(m·K), emissivity (wavelength: 2 to 15 μm): 0.3) was provided as a tailpipe main body. The muffler cutter 1 was welded to the end of the tailpipe main body coaxially with the tailpipe main body (see FIG. 6). The total length L of the resulting tailpipe T (excluding the muffler cutter 1) was 160 mm.

Evaluation of Change in Sound Pressure

Figure 7:
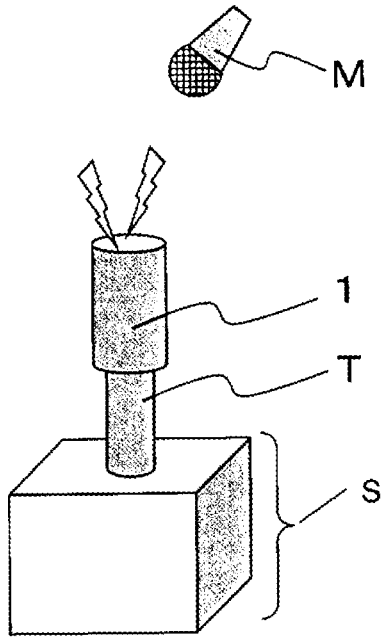
FIG. 7 is a view illustrating a sound pressure level measurement method.

As illustrated in FIG. 7, the tailpipe T was placed upright on a speaker cone of a speaker S so that the tailpipe main body was situated on the lower side and the muffler cutter 1 was situated on the upper side. A sound having a ⅓-octave band frequency of 31.5 Hz to 5 kHz was produced, and a change in the sound pressure level (dB) was measured using a microphone M that was disposed at a distance of 500 mm from the muffler cutter. The results are shown in Table 1 and FIG. 8.

Example 2

An SUS pipe (inner diameter: 52 mm, outer diameter: 54 mm, thermal conductivity (400° C.): 27 W/(m·K)) in which a plurality of holes (openings) were formed in the entire side wall in the longitudinal direction (in the same manner as a perforated metal) was provided as the exhaust pipe 2, and an SUS pipe (inner diameter: 86 mm, outer diameter: 88 mm, thermal conductivity (400° C.): 27 W/(m·K), emissivity (wavelength: 2 to 15 μm): 0.3) consisting of an upper heat shield plate 3*a* and a lower heat shield plate 3*b* (obtained by halving a tubular article) was provided as the tubular heat shield plate 3 (see FIG. 3).

A gap having a width of 16 mm was formed between the exhaust pipe 2 and the tubular heat shield plate 3 when the exhaust pipe 2 and the tubular heat shield plate 3 were positioned coaxially.

A semi-circular (halved) glass wool article (thickness: 16 mm, density: 100 kg/m$^3$, thermal conductivity (400° C.): 0.09 W/(m·K)) was provided as the sound-absorbing heat insulator 4 (see FIG. 3).

The sound-absorbing heat insulator 4 was bonded to the inner surface of the upper heat shield plate 3*a* using an adhesive. The upper heat shield plate 3*a* and the lower heat shield plate 3*b* were placed to surround the exhaust pipe 2, and the ends 3*c* of the upper heat shield plate 3*a* and the lower heat shield plate 3*b* were joined by butt welding (see FIG. 3) to produce a muffler cutter 1 (see FIG. 1) having a structure in which the sound-absorbing heat insulator 4 was provided between the exhaust pipe 2 and the tubular heat shield plate 3 (3*a*) so as to have a curved shape, a closed space S (cavity) having a curved shape was partially formed between the exhaust pipe 2 and the tubular heat shield plate 3 (3*b*), and the distance between the exhaust pipe 2 and the tubular heat shield plate 3 (3*b*) (between which the closed space S was formed) was 16 mm.

An SUS pipe (inner diameter: 52 mm, outer diameter: 54 mm, thermal conductivity (400° C.): 27 W/(m·K), emissivity (wavelength: 2 to 15 μm): 0.3) was provided as a tailpipe main body. The muffler cutter 1 was welded to the end of the tailpipe main body coaxially with the tailpipe main body (see FIG. 6). The total length L of the resulting tailpipe T (excluding the muffler cutter 1) was 160 mm.

A change in sound pressure was measured in the same manner as in Example 1 using the resulting tailpipe T. The results are shown in Table 1 and FIG. 8.

Comparative Example 1

A tailpipe T was produced in the same manner as in Example 1, except that a single-tube pipe (inner diameter: 52 mm, outer diameter: 54 mm, thermal conductivity (400° C.): 27 W/(m·K)) was used instead of the muffler cutter 1. A change in sound pressure was measured in the same manner as in Example 1 using the resulting tailpipe T. The results are shown in Table 1 and FIG. 8.

TABLE 1

| Frequency (Hz) | Example 1 | Example 2 | Comparative Example 1 |
|---|---|---|---|
| 31.5 | 11.9 | 12.6 | 11.0 |
| 40 | 24.7 | 25.4 | 24.2 |
| 50 | 36.0 | 36.6 | 35.6 |
| 63 | 24.5 | 23.9 | 23.3 |
| 80 | 38.8 | 39.3 | 38.2 |
| 100 | 50.6 | 51.0 | 50.0 |
| 125 | 41.5 | 42.1 | 40.9 |
| 160 | 44.0 | 44.9 | 43.0 |
| 200 | 48.8 | 50.1 | 47.3 |
| 250 | 53.9 | 59.0 | 52.6 |
| 315 | 56.5 | 56.5 | 55.3 |
| 400 | 57.4 | 55.6 | 56.2 |
| 500 | 51.8 | 51.3 | 49.5 |
| 630 | 52.5 | 47.7 | 50.3 |
| 800 | 47.0 | 42.6 | 48.0 |
| 1k | 50.5 | 46.8 | 51.0 |
| 1.25k | 52.7 | 44.4 | 53.3 |
| 1.6k | 51.8 | 44.0 | 54.2 |
| 2k | 49.4 | 40.7 | 52.7 |
| 2.5k | 40.0 | 35.4 | 45.4 |
| 3.15k | 34.8 | 32.9 | 41.8 |
| 4k | 41.8 | 39.9 | 49.4 |
| 5k | 34.2 | 32.5 | 40.2 |

Note:
"k" represents "×1,000".

Figure 8:
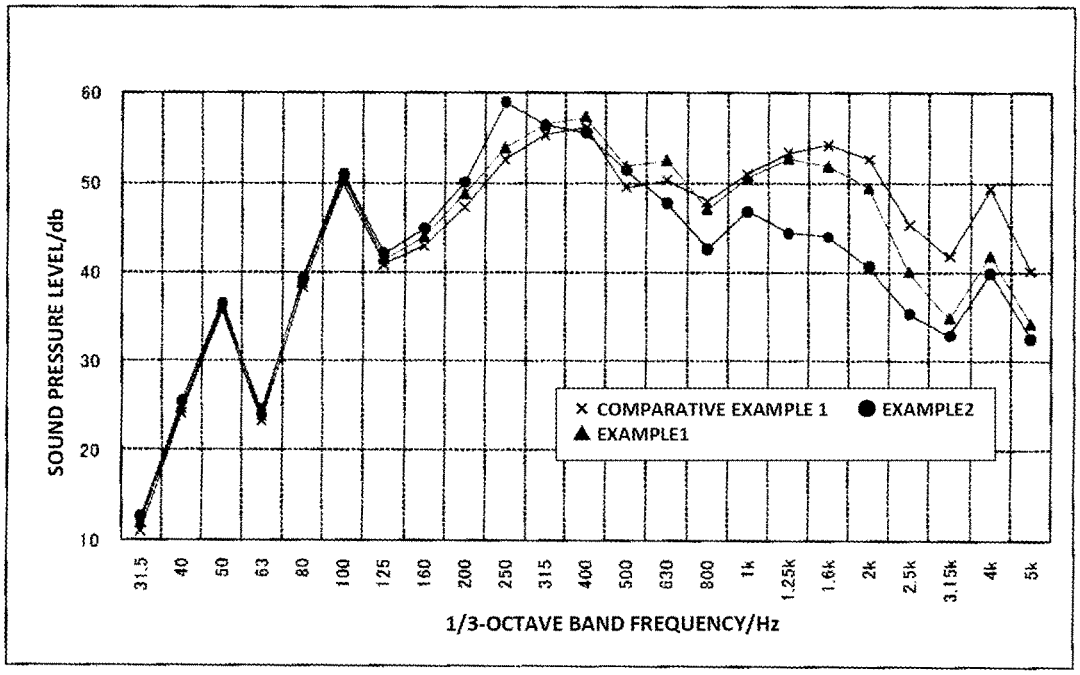
FIG. 8 is a view illustrating a change in the sound pressure level measured using a tailpipe (Examples 1 and 2 and Comparative Example 1).

As is clear from the results shown in Table 1 and FIG. 8, the tailpipes obtained in Examples 1 and 2 (in which a coaxial double pipe structure was formed by the exhaust pipe 2 (in which the through-holes were formed) and the tubular heat shield plate 3, and the sound-absorbing heat insulator 4 was partially provided between the exhaust pipe 2 and the tubular heat shield plate 3 so as to have a curved structure) could decrease the sound pressure level within a high-frequency range from 800 to 5,000 Hz as compared with the tailpipe obtained in Comparative Example 1 in which a single-tube pipe was used. Specifically, the tailpipes obtained in Examples 1 and 2 can selectively reduce only unpleasant high-frequency noise. Moreover, since the closed space S having a curved shape was also formed between the exhaust pipe 2 (in which the through-holes were formed) and the tubular heat shield plate 3, and the distance between the exhaust pipe and the tubular heat shield plate defining the closed space S was controlled to be a given distance, the tailpipes obtained in Examples 1 and 2 could increase the sound pressure level within a low-frequency range from 100 to 200 Hz as compared with the tailpipe obtained in Comparative Example 1 in which a single-tube pipe was used. Specifically, the tailpipes obtained in Examples 1 and 2 can selectively enhance the volume of a low-frequency idling sound for which the user may have a preference.

Reference Example 1

A muffler cutter was produced in the same manner as in Example 1, except that the sound-absorbing heat insulator 4 was not used, and a tailpipe was produced in the same manner as in Example 1 using the resulting muffler cutter.

A change in sound pressure was measured in the same manner as in Example 1 using the resulting tailpipe. The results are shown in Table 2 and FIG. 9.

Figure 9:
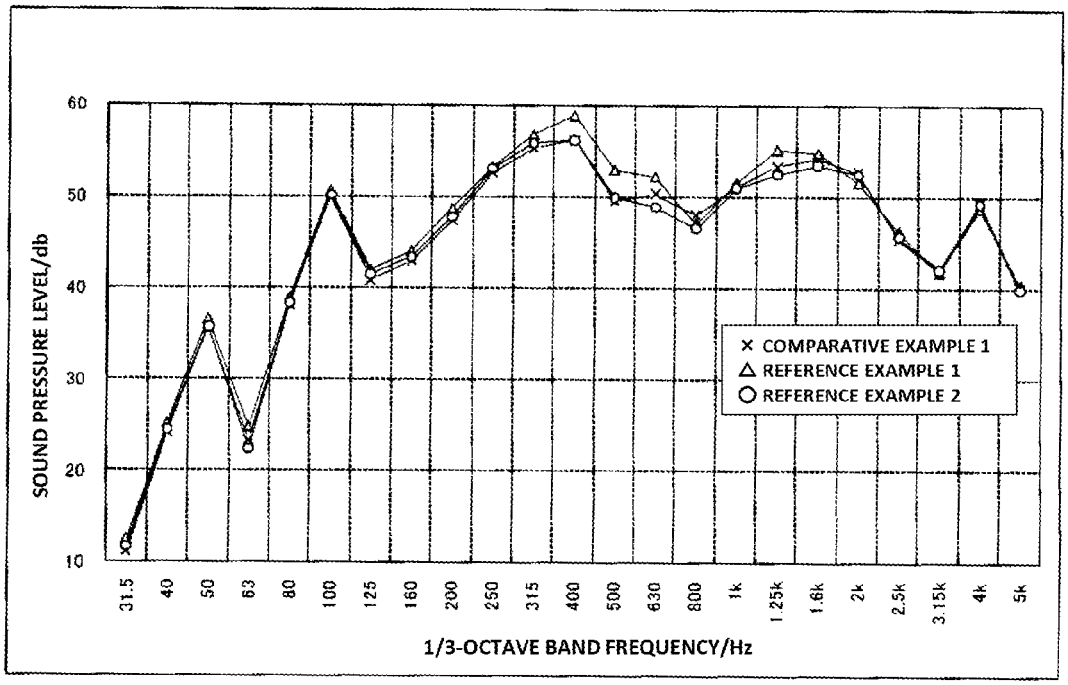
FIG. 9 is a view illustrating a change in the sound pressure level measured using a tailpipe (Reference Examples 1 and 2 and Comparative Example 1).

Note that the results of Comparative Example 1 are also shown in Table 2 and FIG. 9 for comparison.

Reference Example 2

A muffler cutter was produced in the same manner as in Example 1, except that the sound-absorbing heat insulator 4 was not used, and the holes (openings) formed (in the longitudinal direction) in the entire side wall of the SUS pipe used as the exhaust pipe 2 were closed with an aluminum tape (heat-resistant aluminum tape manufactured by Hitachi Maxell, Ltd. (Sliontec Division)), and a tailpipe was produced in the same manner as in Example 1 using the resulting muffler cutter.

A change in sound pressure was measured in the same manner as in Example 1 using the resulting tailpipe. The results are shown in Table 2 and FIG. 9.

TABLE 2

| Frequency | Reference Example 1 | Reference Example 2 | Comparative Example 1 |
|---|---|---|---|
| 31.5 | 12.4 | 11.6 | 11.0 |
| 40 | 25.2 | 24.5 | 24.2 |
| 50 | 36.6 | 35.7 | 35.6 |
| 63 | 24.8 | 22.4 | 23.3 |
| 80 | 38.9 | 38.3 | 38.2 |
| 100 | 50.6 | 50.1 | 50.0 |
| 125 | 41.9 | 41.5 | 40.9 |
| 160 | 44.0 | 43.4 | 43.0 |
| 200 | 48.6 | 47.8 | 47.3 |
| 250 | 53.2 | 53.1 | 52.6 |
| 315 | 56.7 | 55.8 | 55.3 |
| 400 | 58.8 | 56.1 | 56.2 |
| 500 | 52.9 | 49.9 | 49.5 |
| 630 | 52.2 | 48.9 | 50.3 |
| 800 | 47.1 | 46.6 | 48.0 |
| 1k | 51.5 | 51.0 | 51.0 |
| 1.25k | 55.1 | 52.4 | 53.3 |
| 1.6k | 54.8 | 53.4 | 54.2 |
| 2k | 51.6 | 52.5 | 52.7 |
| 2.5k | 46.3 | 45.7 | 45.4 |
| 3.15k | 41.8 | 42.1 | 41.8 |
| 4k | 48.7 | 49.2 | 49.4 |
| 5k | 40.5 | 39.9 | 40.2 |

Note:
"k" represents "×1,000".

As is clear from the results shown in Table 2 and FIG. 9, the tailpipe obtained in Reference Example 1 that was provided with the muffler cutter utilizing the exhaust pipe having punched holes showed a tendency in which the sound pressure level increased within a low-frequency range from 100 to 200 Hz as compared with the tailpipe obtained in Reference Example 2 that was provided with the muffler cutter in which the punched holes formed in the exhaust pipe were closed, and the tailpipe obtained in Comparative Example 1 in which a single-tube pipe was used.

Reference Example 3

Figure 10:
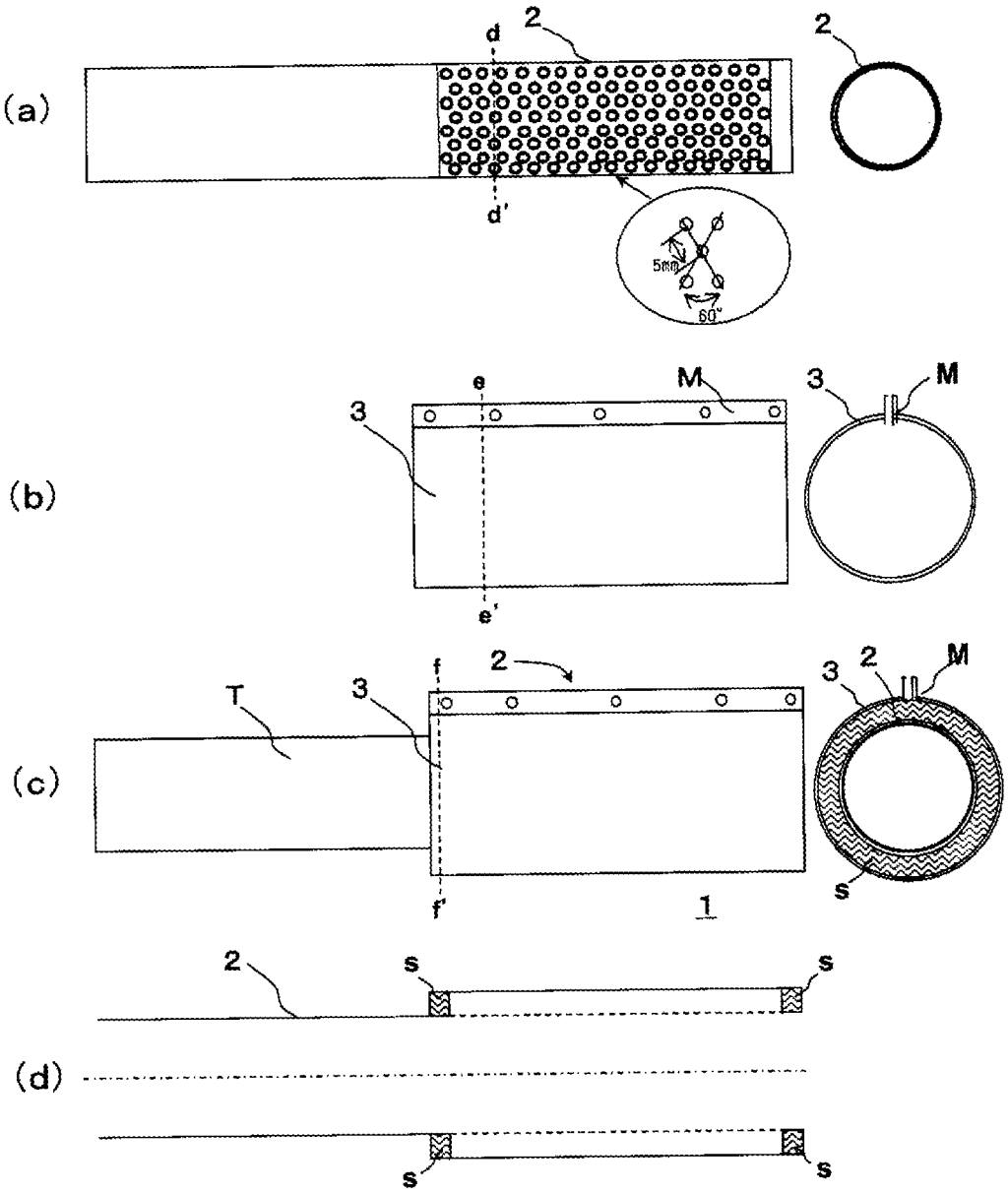
FIG. 10 is a view illustrating the muffler cutter produced in Reference Example 3, wherein (a) is a front view (left side) illustrating the exhaust pipe 2 and a vertical cross-sectional view (right side) taken along the line d-d' (see the front view), (b) is a front view (left side) illustrating the tubular heat shield plate 3 and a vertical cross-sectional view (right side) taken along the line e-e' (see the front view), (c) is a front view (left side) illustrating the muffler cutter in which the tubular heat shield plate 3 (see (b)) is provided coaxially with the exhaust pipe 2 (see (a)) and a vertical cross-sectional view (right side) taken along the line f-f' (see the front view), and (d) is a vertical cross-sectional view illustrating the muffler cutter (see (c)) along the longitudinal direction.

FIG. 10 is a view illustrating the muffler cutter produced in Reference Example 3, wherein (a) is a front view (left side) illustrating the exhaust pipe 2 and a vertical cross-sectional view (right side) taken along the line d-d' (see the front view), (b) is a front view (left side) illustrating the tubular heat shield plate 3 and a vertical cross-sectional view (right side) taken along the line e-e' (see the front view), (c) is a front view (left side) illustrating the muffler cutter in which the tubular heat shield plate 3 (see (b)) is provided coaxially with the exhaust pipe 2 (see (a)) and a vertical cross-sectional view (right side) taken along the line f-f' (see the front view), and (d) is a vertical cross-sectional view illustrating the muffler cutter (see (c)) along the longitudinal direction.

In Reference Example 3, 576 circular through-holes (diameter 3 mm) were formed in the side wall of one side of an SUS single-tube pipe (outer diameter: 54 mm, thickness: 0.4 mm, length: 340 mm, thermal conductivity (400° C.): 27 W/(m·K)) at an interval of 5 mm in the longitudinal direction to form the exhaust pipe 2 (perforated metal) on one side of the single-tube pipe.

An SUS pipe (outer diameter: 72 mm, thickness: 1.0 mm, thermal conductivity (400° C.): 27 W/(m·K), emissivity (wavelength: 2 to 15 μm): 0.3) (provided with a fastening edge M) (see (b) in FIG. 10) was provided as the tubular heat shield plate 3. The tubular heat shield plate 3 was provided around the outer surface of the exhaust pipe 2 through two aluminum ring-like spacers s (outer diameter: 70 mm, inner diameter: 54 mm, thickness: 10 mm). A bolt was inserted into a bolt hole formed in the edge M of the heat shield plate 3, and the heat shield plate 3 was fastened to produce the muffler cutter 1 in which the exhaust pipe 2 and the tubular heat shield plate 3 were provided to the end of the tailpipe T at a distance of 8 mm (see (c) and (d) in FIG. 10).

Evaluation of Change in Sound Pressure

As illustrated in FIG. 7, the tailpipe T was placed upright on a speaker cone of a speaker S so that the tailpipe main body was situated on the lower side and the muffler cutter 1 was situated on the upper side. White noise (⅓-octave band frequency) was produced, and a change in the sound pressure level (dB) was measured using a microphone M that was disposed at a distance of 500 mm from the muffler cutter. The results are shown in Table 3 and FIG. 11.

Reference Example 4

An SUS pipe (outer diameter: 88 mm, thickness: 1.0 mm, thermal conductivity (400° C.): 27 W/(m·K), emissivity (wavelength: 2 to 15 μm): 0.3) (provided with a fastening edge M) was provided as the tubular heat shield plate 3 instead of the heat shield plate having an outer diameter of 72 mm (see Reference Example 3). The tubular heat shield plate 3 was provided around the outer surface of the exhaust pipe 2 through two aluminum ring-like spacers s (outer diameter: 86 mm, inner diameter 54 mm, thickness: 10 mm). A bolt was inserted into a bolt hole formed in the edge M of the heat shield plate 3, and the heat shield plate 3 was fastened to produce the muffler cutter 1 in which the exhaust pipe 2 and the tubular heat shield plate 3 were provided to the end of the tailpipe T at a distance of 16 mm (see (c) and (d) in FIG. 10).

A change in sound pressure was measured in the same manner as in Reference Example 3 using the resulting tailpipe T. The results are shown in Table 3 and FIG. 11.

Reference Example 5

An SUS pipe (outer diameter: 146 mm, thickness: 1.0 mm, thermal conductivity (400° C.): 27 W/(m·K), emissivity (wavelength: 2 to 15 μm): 0.3) (provided with a fastening edge M) was provided as the tubular heat shield plate 3 instead of the heat shield plate having an outer diameter of 72 mm (see Reference Example 1). The tubular heat shield plate 3 was provided around the outer surface of the exhaust pipe 2 through two aluminum ring-like spacers s (outer diameter: 144 mm, inner diameter: 54 mm, thickness: 10 mm). A bolt was inserted into a bolt hole formed in the edge M of the heat shield plate 3, and the heat shield plate 3 was fastened to produce the muffler cutter 1 in which the exhaust pipe 2 and the tubular heat shield plate 3 were provided to the end of the tailpipe T at a distance of 45 mm (see (c) and (d) in FIG. 10).

A change in sound pressure was measured in the same manner as in Reference Example 3 using the resulting tailpipe T. The results are shown in Table 3 and FIG. 11.

Comparative Example 2

An SUS single-tube pipe (outer diameter: 54 mm, thickness: 0.4 mm, length: 340 mm, thermal conductivity (400° C.): 27 W/(m·K)) was used instead of the tailpipe T, and a change in sound pressure was measured in the same manner as in Reference Example 1. The results are shown in Table 3 and FIG. 11.

TABLE 3

| Frequency (Hz) | Reference Example 3 | Reference Example 4 | Reference Example 5 | Comparative Example 2 |
|---|---|---|---|---|
| 200 | 56.2 | 58.2 | 70 | 54.2 |
| 250 | 61.3 | 65.3 | 69.4 | 58.7 |
| 315 | 68.0 | 71.8 | 60.6 | 64.6 |
| 400 | 67.2 | 65.2 | 58.2 | 63.8 |
| 500 | 62.1 | 61.4 | 57.6 | 59.2 |
| 630 | 66.5 | 64.1 | 57.4 | 63.5 |
| 800 | 61.9 | 58.3 | 53.6 | 63.7 |
| 250 | 61.3 | 65.3 | 69.4 | 58.7 |
| 315 | 68.0 | 71.8 | 60.6 | 64.6 |
| 400 | 67.2 | 65.2 | 58.2 | 63.8 |
| 500 | 62.1 | 61.4 | 57.6 | 59.2 |
| 630 | 66.5 | 64.1 | 57.4 | 63.5 |
| 800 | 61.9 | 58.3 | 53.6 | 63.7 |

Figure 11:
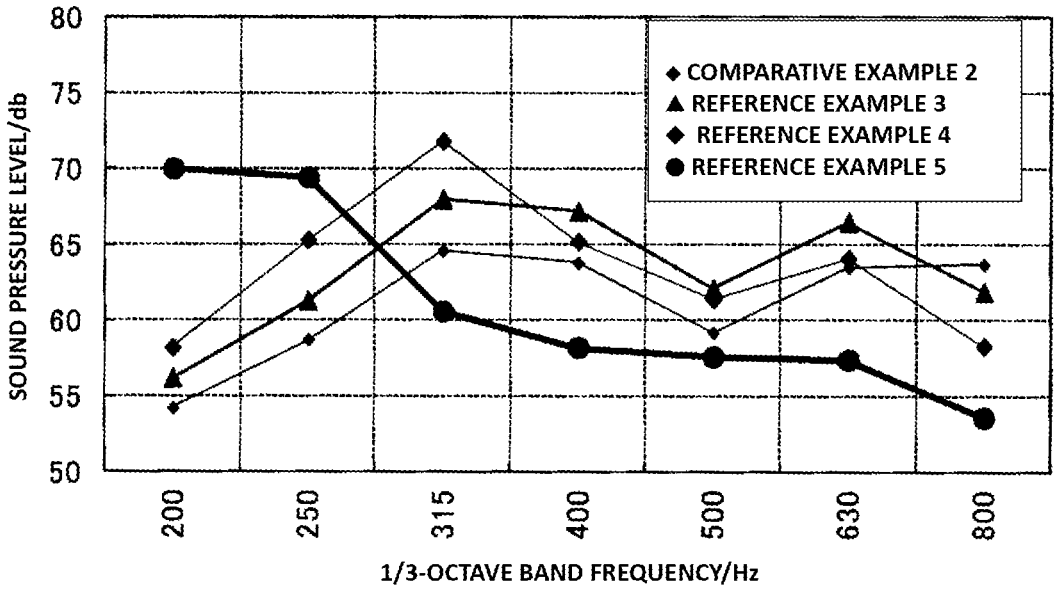
FIG. 11 is a view illustrating a change in the sound pressure level measured using a tailpipe (Reference Examples 3 to 5 and Comparative Example 2).

As is clear from the results shown in Table 3 and FIG. 11, the tailpipes obtained in Reference Examples 3 to 5 (in which a coaxial double pipe structure was formed by the exhaust pipe 2 (in which the through-holes were formed) and the tubular heat shield plate 3) could decrease the sound pressure level at a high frequency of 800 Hz as compared with the single-tube pipe used in Comparative Example 2. Specifically, the tailpipes obtained in Reference Examples 3 to 5 can selectively reduce only unpleasant high-frequency noise. Moreover, since the closed space having a curved shape was also formed between the exhaust pipe 2 and the tubular heat shield plate 3, and the distance between the exhaust pipe and the tubular heat shield plate defining the closed space was controlled to be a given distance, the tailpipes obtained in Reference Examples 3 to S could increase the sound pressure level at a low frequency of 200 Hz as compared with the single-tube pipe used in Comparative Example 2. Specifically, the tailpipes obtained in Reference Examples 3 to 5 can selectively enhance the volume of a low-frequency idling sound for which the user may have a preference.

Reference Example 6

A muffler cutter 1 in which the exhaust pipe 2 and the tubular heat shield plate 3 were provided to the end of the tailpipe T at a distance of 45 mm was produced in the same manner as in Reference Example 5, except that circular through-holes were not formed in the SUS single-tube pipe (outer diameter 54 mm, thickness: 1.0 mm, length: 340 mm, thermal conductivity (400° C.): 27 W/(m·K)).

A change in sound pressure was measured in the same manner as in Reference Example 3 using the resulting tailpipe T. The results are shown in Table 4 and FIG. 13.

Figure 13:
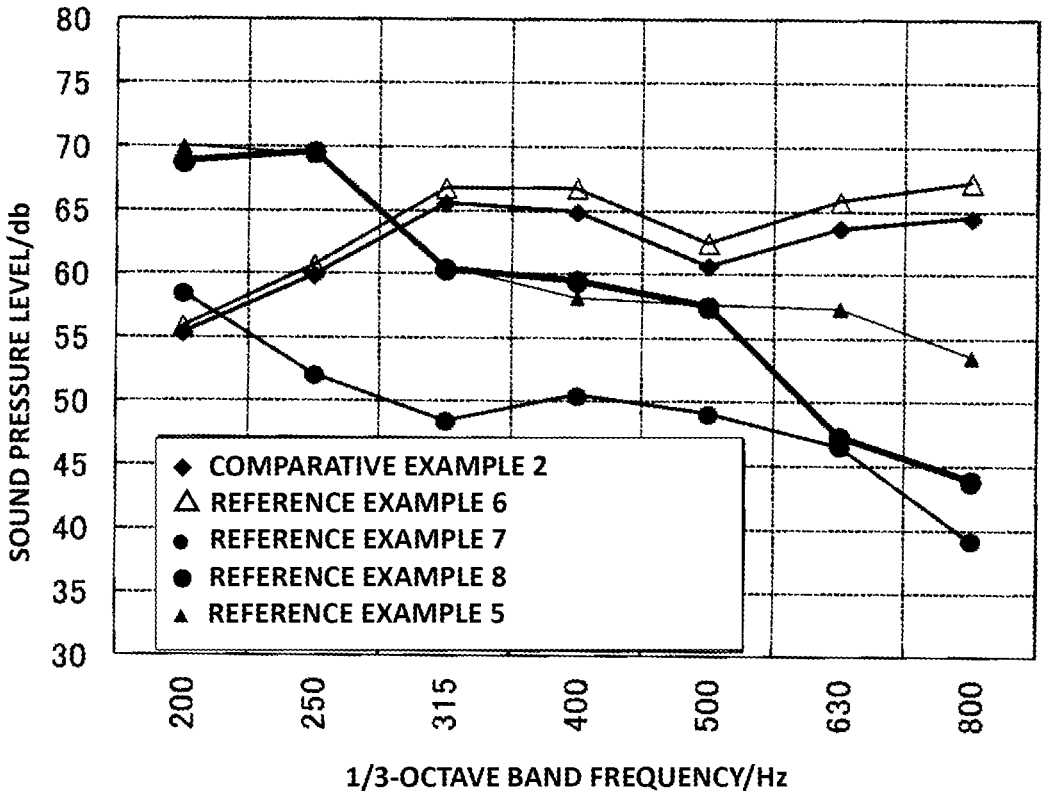
FIG. 13 is a view illustrating a change in the sound pressure level measured using a tailpipe (Reference Examples 5 to 8 and Comparative Example 2).

Note that the results of Reference Example 5 and Comparative Example 2 are also shown in Table 4 and FIG. 13 for comparison.

Reference Example 7

Figure 12:
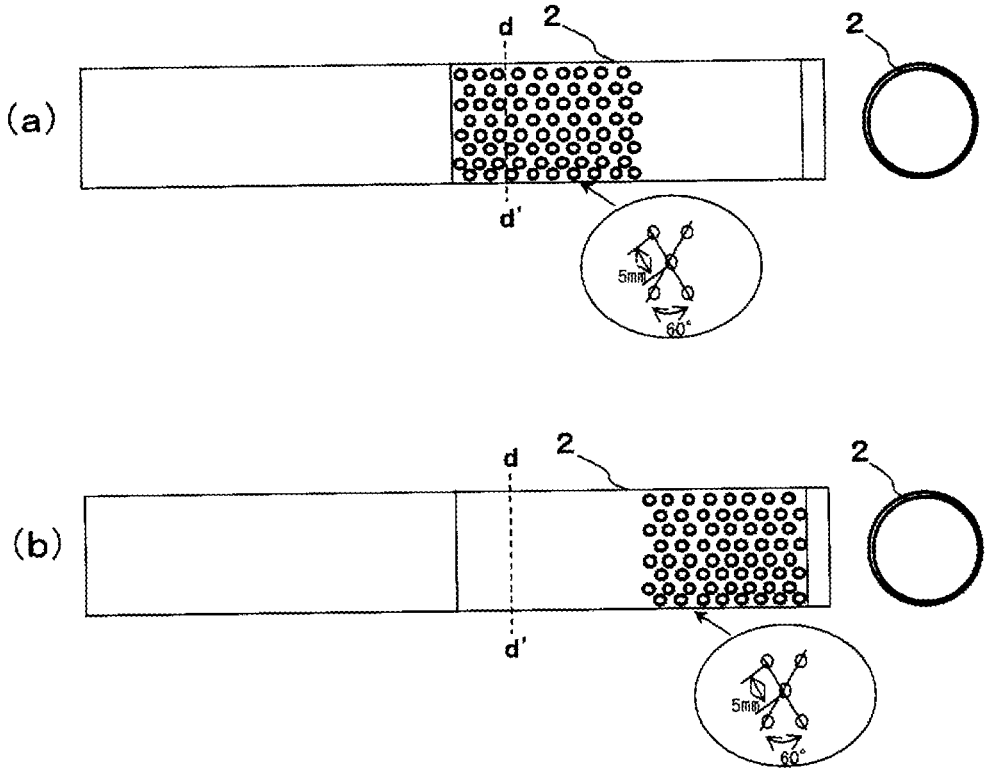
FIG. 12 is a view illustrating the exhaust pipe of the muffler cutters obtained in Reference Examples 7 and 8, wherein (a) illustrates the exhaust pipe 2 in which circular through-holes are formed in the upstream-side (i.e., exhaust gas inflow side) side wall, and (b) illustrates the exhaust pipe 2 in which circular through-holes are formed in the downstream-side (i.e., exhaust gas discharge side) side wall.

A muffler cutter 1 in which the exhaust pipe 2 and the tubular heat shield plate 3 were provided to the end of the tailpipe T at a distance of 45 mm was produced in the same manner as in Reference Example 5, except that 288 circular through-holes (diameter 3 mm) were formed in the upstream-side (exhaust gas inflow side) side wall of one side of an SUS single-tube pipe (outer diameter: 54 mm, thickness: 1.0 mm, length: 340 mm, thermal conductivity (400° C.): 27 W/(m·K)) at an interval of 5 mm (see (a) in FIG. 12).

A change in sound pressure was measured in the same manner as in Reference Example 3 using the resulting tailpipe T. The results are shown in Table 4 and FIG. 13.

Reference Example 8

A muffler cutter 1 in which the exhaust pipe 2 and the tubular heat shield plate 3 were provided to the end of the tailpipe T at a distance of 45 mm was produced in the same manner as in Reference Example 5, except that 288 circular through-holes (diameter: 3 mm) were formed in the downstream-side (exhaust gas discharge side) side wall of one side of an SUS single-tube pipe (outer diameter: 54 mm, thickness: 1.0 mm, length: 340 mm, thermal conductivity (400° C.): 27 W/(m·K)) at an interval of 5 mm (see (b) in FIG. 12).

A change in sound pressure was measured in the same manner as in Reference Example 3 using the resulting tailpipe T. The results are shown in Table 4 and FIG. 13.

TABLE 4

| Frequency (Hz) | Reference Example 6 | Reference Example 7 | Reference Example 8 | Reference Example 5 | Comparative Example 2 |
|---|---|---|---|---|---|
| 200 | 55.9 | 58.5 | 68.8 | 70 | 55.4 |
| 250 | 60.7 | 52.1 | 69.6 | 69.4 | 59.9 |
| 315 | 66.8 | 48.5 | 60.4 | 60.6 | 65.6 |
| 400 | 66.8 | 50.5 | 59.5 | 58.2 | 64.9 |
| 500 | 62.5 | 49.1 | 57.5 | 57.6 | 60.7 |
| 630 | 65.8 | 46.6 | 47.3 | 57.4 | 63.7 |
| 800 | 67.3 | 39.2 | 43.9 | 53.6 | 64.5 |

As is clear from the results shown in Table 4 and FIG. 13, the tailpipe obtained in Reference Example 6 (in which a coaxial double pipe structure was formed by the exhaust pipe 2 (in which through-holes were not formed) and the tubular heat shield plate 3) could increase the sound pressure level over the entire measurement frequency range as compared with the single-tube pipe used in Comparative Example 2.

The tailpipes obtained in Reference Examples 5, 7, and 8 (in which a coaxial double pipe structure was formed by the exhaust pipe 2 (in which the through-holes were formed) and the tubular heat shield plate 3, and the distance between the exhaust pipe and the tubular heat shield plate defining the closed space was controlled to be a given distance) could decrease the sound pressure level at a high frequency of 800 Hz as compared with Comparative Example 2 and Reference Example 6. Specifically, the tailpipes obtained in Reference Examples 5, 7, and 8 can selectively reduce only unpleasant high-frequency noise. Moreover, the tailpipes obtained in Reference Examples 5, 7, and 8 could increase the sound pressure level at a low frequency of 200 Hz as compared with Comparative Example 2 and Reference Example 6. Specifically, the tailpipes obtained in Reference Examples 5, 7, and 8 can selectively enhance the volume of a low-frequency idling sound for which the user may have a preference.

The tailpipe obtained in Reference Example 7 decreased the sound pressure level over the entire frequency range as compared with the tailpipe obtained in Reference Example 8. It is considered that interference of exhaust noise easily occurred when using the tailpipe obtained in Reference Example 7 in which the through-holes were formed on the upstream-side (exhaust gas inflow side) of the exhaust pipe 2 as compared with the tailpipe obtained in Reference Example 8 in which the through-holes were formed on the downstream-side of the exhaust pipe 2.

Heat-Insulating Capability Test

A heater was provided inside the muffler cutter 1 obtained in Example 1. A polyimide bumper was provided outside the muffler cutter 1 on the side where the sound-absorbing heat insulator 4 was provided (on the side of the upper heat shield plate 3*a*). The surface temperature of the bumper when the heater was operated (output: 440 W) for 90 minutes was measured while changing the distance between the muffler cutter 1 and the bumper within the range from 12 to 29 mm. The results are shown in Table 5.

The surface temperature of the bumper was also measured in the same manner as described above using a muffler cutter produced in the same manner as in Example 1, except that the sound-absorbing heat insulator 4 was not provided (hereinafter referred to as "hollow double pipe"), and a muffler cutter in which the entire space formed between the exhaust pipe 2 and the tubular beat shield plate was filled with the sound-absorbing heat insulator 4 (hereinafter referred to as "fully-filled double pipe").

The results are shown in Table 5.

TABLE 5

| | | Muffler cutter 1 obtained in Example 1 | Hollow double pipe | Fully-filled double pipe |
|---|---|---|---|---|
| Distance | 12 mm | 171° C. | — | 171° C. |
| | 14 mm | 158° C. | 188° C. | 160° C. |
| | 19 mm | 144° C. | 169° C. | 147° C. |
| | 24 mm | 138° C. | 158° C. | 145° C. |
| | 29 mm | 132° C. | 151° C. | 137° C. |

As shown in Table 5, the muffler cutter 1 obtained in Example 1 could sufficiently reduce an increase in the surface temperature of the bumper as compared with the hollow double pipe in which the sound-absorbing heat insulator was not provided.

As shown in Table 5, the muffler cutter 1 obtained in Example 1 (in which the sound-absorbing heat insulator was partially provided between the exhaust pipe and the tubular heat shield plate) could suppress radiation of heat toward the bumper, and reduce an increase in the surface temperature of the bumper at a level equal to or higher than that achieved by the muffler cutter (fully-filled double pipe) in which the entire space formed between the exhaust pipe and the tubular heat shield plate was filled with the sound-absorbing heat insulator.

INDUSTRIAL APPLICABILITY

The embodiments of the invention can provide a muffler cutter that exhibits an excellent heat-insulating capability and an excellent sound-absorbing capability, and can improve the exhaust sound quality. The embodiments of the invention can also provide a tailpipe, the muffler cutter being fitted to the end of the tailpipe.

REFERENCE SIGNS LIST

1 Muffler cutter
2 Exhaust pipe
3 Tubular heat shield plate
3*a* Upper heat shield plate
3*b* Lower heat shield plate
3*c* End
4 Sound-absorbing heat insulator
5 Vehicle main body
6 Fourier transform infrared spectrophotometer
71 Incident light
72 Reflected light or transmitted light
8 Mirror
9 Rotary stage
10 Sample
11 Halogen heater
12 Detector
13 Cooling water
X High-temperature reflectivity-transmissivity measurement device
h Holder
S Closed space
T Tailpipe
S Speaker
M Microphone

The invention claimed is:

1. A muffler cutter that is fitted to a tailpipe of a vehicular exhaust system, the muffler cutter comprising:

an exhaust pipe, a plurality of through-holes being formed in a side wall of the exhaust pipe;

a tubular heat shield plate provided around the exhaust pipe coaxially with the exhaust pipe;

a space defined by the exhaust pipe and tubular heat shield plate, the space having a first portion and a second portion; and a sound-absorbing heat insulator provided only in the first portion of the space, wherein the first portion and the second portion of the space each has a curved shape, the sound-absorbing heat insulator has a curved shape, the second portion of the space is a hollow and closed space, and the exhaust pipe is spaced 1 to 50 mm apart from the tubular heat shield plate in the second portion of the space.

2. The muffler cutter according to claim 1, wherein the plurality of through-holes are formed in at least an area of the side wall of the exhaust pipe that is situated opposite to the sound-absorbing heat insulator.

3. The muffler cutter according to claim 1, wherein the sound-absorbing heat insulator is situated on a side of a vehicle main body when the muffler cutter is fitted.

4. The muffler cutter according to claim 2, wherein the sound-absorbing heat insulator is situated on a side of a vehicle main body when the muffler cutter is fitted.

5. The muffler cutter according to claim 3, wherein the closed space is situated opposite to the vehicle main body when the muffler cutter is fitted.

6. The muffler cutter according to claim 4, wherein the closed space is situated opposite to the vehicle main body when the muffler cutter is fitted.

7. The muffler cutter according claim 1, wherein the sound-absorbing heat insulator has a thermal conductivity measured at 400° C. of 0.01 to 0.1 W/(m·K).

8. The muffler cutter according claim 2, wherein the sound-absorbing heat insulator has a thermal conductivity measured at 400° C. of 0.01 to 0.1 W/(m·K).

9. The muffler cutter according claim 3, wherein the sound-absorbing heat insulator has a thermal conductivity measured at 400° C. of 0.01 to 0.1 W/(m·K).

10. The muffler cutter according claim 4, wherein the sound-absorbing heat insulator has a thermal conductivity measured at 400° C. of 0.01 to 0.1 W/(m·K).

11. The muffler cutter according claim 5, wherein the sound-absorbing heat insulator has a thermal conductivity measured at 400° C. of 0.01 to 0.1 W/(m·K).

12. The muffler cutter according claim 6, wherein the sound-absorbing heat insulator has a thermal conductivity measured at 400° C. of 0.01 to 0.1 W/(m·K).

13. The muffler cutter according claim 1, wherein the closed space covers 20-80% of a total outer surface area of the exhaust pipe.

14. The muffler cutter according claim 1, wherein the sound absorbing heat insulator covers 20-80% of a total outer surface area of the exhaust pipe.

15. The muffler cutter according claim 1, wherein the closed space is defined by the exhaust pipe, the tubular heat shield plate, and the sound absorbing heat insulator.

16. The muffler cutter according claim 15, wherein exhaust gas enters the closed space from the plurality of through-holes formed in the exhaust pipe and through the sound absorbing heat insulator.

17. The muffler cutter according to claim 1, wherein a total length of the tailpipe provided with the muffler cutter is 50 to 500 mm.

18. The muffler cutter according to claim 1, wherein the plurality of through-holes are formed in 1 to 95% of an area of a total outer surface of the exhaust pipe.

19. The muffler cutter according to claim 1, wherein a bulk density of the sound-absorbing heat insulator is 50 to 400 kg/$m^3$.

20. The muffler cutter according to claim 1, wherein the plurality of through-holes are formed in 25-50% of an area of a total outer surface of the exhaust pipe.

* * * * *